US005230717A

United States Patent [19]

Ogawa et al.

[11] Patent Number: 5,230,717

[45] Date of Patent: Jul. 27, 1993

[54] PRESSURIZED GASSIFICATION APPARATUS

[75] Inventors: Kiichiro Ogawa, Tokyo; Yoshitaka Koga, Nagasaki; Hiroshi Akiyama, Nagasaki; Mitsuharu Takaki, Nagasaki, all of Japan

[73] Assignee: Mitsubishi Jukogyo Kabushiki Kaisha, Tokyo, Japan

[21] Appl. No.: 707,001

[22] Filed: May 29, 1991

[30] Foreign Application Priority Data

May 30, 1990 [JP] Japan ..... 2-138388

[51] Int. Cl.[5] ..... C10J 3/48; C10J 3/74; C10J 3/76; C10J 3/86

[52] U.S. Cl. ..... 48/76; 48/67; 122/7 R

[58] Field of Search ..... 48/62 R, 63, 67, 69, 48/77, 76; 55/269; 122/5, 6 A, 7 R

[56] References Cited

U.S. PATENT DOCUMENTS

| | | | |
|---|---|---|---|
| 2,862,480 | 12/1958 | Oberg | 122/379 |
| 4,610,697 | 9/1986 | Darling et al. | 48/77 |
| 4,950,308 | 8/1990 | Lang et al. | 48/67 |

FOREIGN PATENT DOCUMENTS

| | | | |
|---|---|---|---|
| 094097 | 11/1983 | European Pat. Off. . | |
| 1228092 | 10/1986 | Japan | 48/62 R |
| 1238886 | 10/1986 | Japan | 48/62 R |
| 1250094 | 11/1986 | Japan | 48/67 |
| 2081489 | 4/1987 | Japan | 48/67 |
| 3086795 | 4/1988 | Japan | 48/67 |
| 3086796 | 4/1988 | Japan | 48/67 |

OTHER PUBLICATIONS

Patent Abstracts of Japan, vol. 12, No. 316 (C-524)(3163) Aug. 26, 1988.

*Primary Examiner*—Peter Kratz

*Attorney, Agent, or Firm*—Wenderoth, Lind & Ponack

[57] ABSTRACT

A gasification furnace main body, having both a water-cooled wall structure and a duct having a water-cooled wall structure and containing therein a group of gas cooling heat-exchangers disposed within a pressure vessel, is improved in order to prevent a reduction in temperature of gas within the pressure vessel which would otherwise occur due to convection and to avoid the risk of fire and explosion which would otherwise be created by char accumulating within the pressure vessel. The improvements reside in an outlet of the duct and the inside of the pressure vessel communicating with each other at a defined location in the apparatus, a partition wall connecting the wall of the duct with an inner wall surface of the pressure vessel at a level higher than that location, and equalizing valves for placing the spaces on respective sides of the partition wall in communication with each other when a pressure difference between the respective sides of the partition wall has become a predetermined value or larger.

3 Claims, 4 Drawing Sheets

PRESSURIZED GASSIFICATION APPARATUS

BACKGROUND OF THE INVENTION

1. Field of the Invention

The present invention relates to improvements in a pressurized type gasification apparatus which includes a gasification furnace main body having a water-cooled wall structure and a duct having a water-cooled wall structure and containing therein a group of gas cooling heat-exchangers for recovering heat from gas produced in the gasification furnace main body.

2. Description of the Prior Art

Every one of FIGS. 4 to 6 illustrates a different example of a pressurized type coal gasification apparatus in the prior art.

At first, FIG. 4 shows one example of such apparatus having a single-wall structure, in which reference character a designates a gasification furnace main body, character b designates a water-cooled wall, character c designates a heat insulating material, character d designates a pressure vessel, and character e designates an ash hopper. In a pressurized type gasification apparatus, since the interior of the gasification furnace main body is at high-temperature and high-pressure, in the case of a furnace wall having a single-wall structure such as the illustrated example, in view of a structural strength it was necessary to form the furnace wall as an extremely thick wall structure. However, not only is a thick furnace wall costly to manufacture but there is also a shortcoming in that the furnace is quickly damaged because a thermal radiation effect cannot be obtained. Thus, this water-cooled structure does not adapt well to the high-temperature and high-pressure conditions of the interior of the furnace and is not economical if a sufficient wall strength is to be provided.

Hence, as shown in FIG. 5, a pressurized type gasification apparatus having a so-called double-wall structure, in which a gasification furnace main body is disposed within a pressure vessel, was proposed (Japanese Patent Application No. 60-48202 (1985), Laid-Open Japanese patent Specification No. 61-207492 (1986)). This double-wall structure is constructed of a gasification furnace main body 01 and a pressure vessel 06 containing the former therein. The inner pressure of the pressure vessel 06 is maintained at a pressure equal to or a little lower than the inner pressure of the gasification furnace main body 01. A pressure difference arises due to the high pressure within the gasification furnace main body 01 being present in a stepped portion of the gasification furnace main body 01. In this case, the wall of the gasification furnace main body 01 can be thin. Also, a high thermal radiation effect can be produced by employing, for example, a water-cooled wall structure. Therefore, there is an advantage in that the gasification furnace main body has a long life.

However, in the case of employing such a double-wall structure, the pressure within the pressure vessel 06 must be maintained at a certain fixed pressure in correspondence with the pressure within the gasification furnace main body 01. Therefore, in the example shown in FIG. 5, a pressurized inert gas 040 is injected to the interior of the pressure vessel 06 (the exterior of the gasification furnace main body 01). In this case, the pressure of the inert gas fed into the pressure vessel 06 must be varied in correspondence with the pressure change within the gasification furnace main body 01 produced upon operation of the apparatus. Consequently, there is a shortcoming in that a complicated device or equipment is necessary for adjusting and controlling the feeding pressure of the inert gas by detecting the pressure within the furnace by means of a differential pressure gauge 041.

In order to eliminate these shortcomings, a pressurized type gasification apparatus illustrated in FIG. 6 was proposed (Japanese Patent Application No. 60-221324 (1985), Laid-Open Japanese Patent Specification NO. 62-81489 (1987)). In this apparatus, an interior of a pressure vessel 06 accommodating a gasification furnace main body 01 and an interior of a pressure vessel 013 accommodating a water-cooled wall 014 surrounding a heat-exchanger group 07 communicating with the interior of the gasification furnace main body 01 communicate with each other through a balance pipe 016. And, at a slag ejection port 03 of the gasification furnace main body 01 is provided a gas sealing device 018 providing a water seal. In addition, at an outlet of the water-cooled wall 014 is provided a gas receiver 011 mounted to the pressure vessel 013, and between the water-cooled wall 014 and the pressure vessel 013, and between the water-cooled wall 014 and the pressure vessel 013 is formed a gas passageway 036 through which a produced gas at a low temperature can freely flow in and flow out.

In the apparatus shown in FIG. 6, the pressure within the pressure vessel 013 can be controlled in a self-balancing manner by allowing a low-temperature produced gas at the outlet of the water-cooled wall 014 surrounding the heat-exchanger group 07 to freely flow into the pressure vessel 013, and hence a constant pressure difference can be maintained conforming to the pressure variations within the gasification furnace main body 01. Consequently, pressure control can be achieved very economically and reliably without necessitating special pressure detector means or control means. In addition, by providing the outlet of the water-cooled wall 014 as a free end, a difference in thermal expansion between the water-cooled wall 014 and the pressure vessel 013 can be accommodated for. Furthermore, since the sealing device 018 employing a water seal is provided at the slag ejection port 03 of the gasification furnace main body 01, a difference in thermal expansion between the gasification furnace main body 01 and the pressure vessel 06 also can be accommodated for.

However, the pressurized type gasification apparatus shown in FIG. 6 and described is not considered to be favorable in view of performance for the following reasons, and especially for reasons of safety, because a low-temperature gas at the outlet of the water-cooled wall can freely flow into and flow out from the pressure vessel 013 without being subjected to any restriction.

That is, the gas flowing into the pressure vessel 013 fills the interior of the same vessel. And the gas coming into contact with the water-cooled wall 014 is partly heated by heat dissipating from the inside of the water-cooled wall resulting in a reduction of its specific gravity, whereby it rises along the water-cooled wall 014. A gas filling the upper portion is displaced downward due to a difference in the specific gravity of the gases. In other words, natural convection would occur within the pressure vessel 013. Since this low-temperature gas having fallen due to natural convection passes through the gas passageway 036, mixes into a principal flow and lowers the temperature of the produced gas, the condition of the gas fed to an apparatus in the succeeding stage becomes unstable. As this is caused by a natural convection phenomenon, it is difficult to preliminarily estimate the amount of temperature change, and it is impossible to control it.

In addition, when the produced gas at the outlet of the water-cooled wall 014 flows into the pressure vessel 013 as described above, an unburnt carbon content (char) contained in the produced gas also enters the pressure vessel. Char accumulating within the pressure vessel is undesirable in view of maintenance and management of the apparatus and from the viewpoint of safety because the accumulated material may ignite and may cause fire due to various circumstances and it may even create a disaster such as an explosion or the like.

SUMMARY OF THE INVENTION

It is therefore one object of the present invention to provide a pressurized type gasification apparatus having a double-wall structure in which a reduction in temperature of a produced gas caused by natural convection within a pressure vessel is prevented and a risk of fire and explosion caused by the accumulation of char within a pressure vessel is eliminated.

According to one feature of the present invention, there is provided an improved pressurized type gasification apparatus in which a gasification furnace main body having a water-cooled wall structure and a duct having a water-cooled structure and containing therein a group of gas cooling heat-exchangers for recovering heat from gas produced in the gasification furnace main body are disposed within a pressure vessel, wherein the improvements reside in an outlet of the duct and the inside of the pressure vessel communicating with each other, a partition wall connecting the wall of the duct with an inner wall surface of the pressure vessel at a level higher than the location where the outlet of the duct communicates with the interior of the pressure vessel, and in that there are provided equalizing valves for placing the respective spaces on opposite sides of the partition wall in communication with each other when a pressure difference between the respective sides of the partition has become a predetermined value or larger.

According to the present invention, because the partition wall is provided at a level higher than the location where the outlet of the duct communicates with the interior of the pressure vessel, the above-mentioned problems caused by the natural convection within the pressure vessel are obviated.

In addition, when a difference between the pressure within the gasification furnace main body and the water-cooled wall accommodating the heat-exchanger group and the pressure within a pressure vessel containing therein the water-cooled wall has reached a certain value or larger, the equalizing valves are opened, whereby safety is insured.

BRIEF DESCRIPTION OF THE DRAWINGS

The above-mentioned and other objects, features and advantages of the present invention will become more apparent by referring to the following description of one preferred embodiment of the invention taken in conjunction with the accompanying drawings.

In the accompanying drawings.

DETAILED DESCRIPTION OF THE PREFERRED EMBODIMENTS

Now, the present invention will be described in greater detail with reference to FIGS. 1 to 3 which illustrate one preferred embodiment of the invention.

Figure 1:
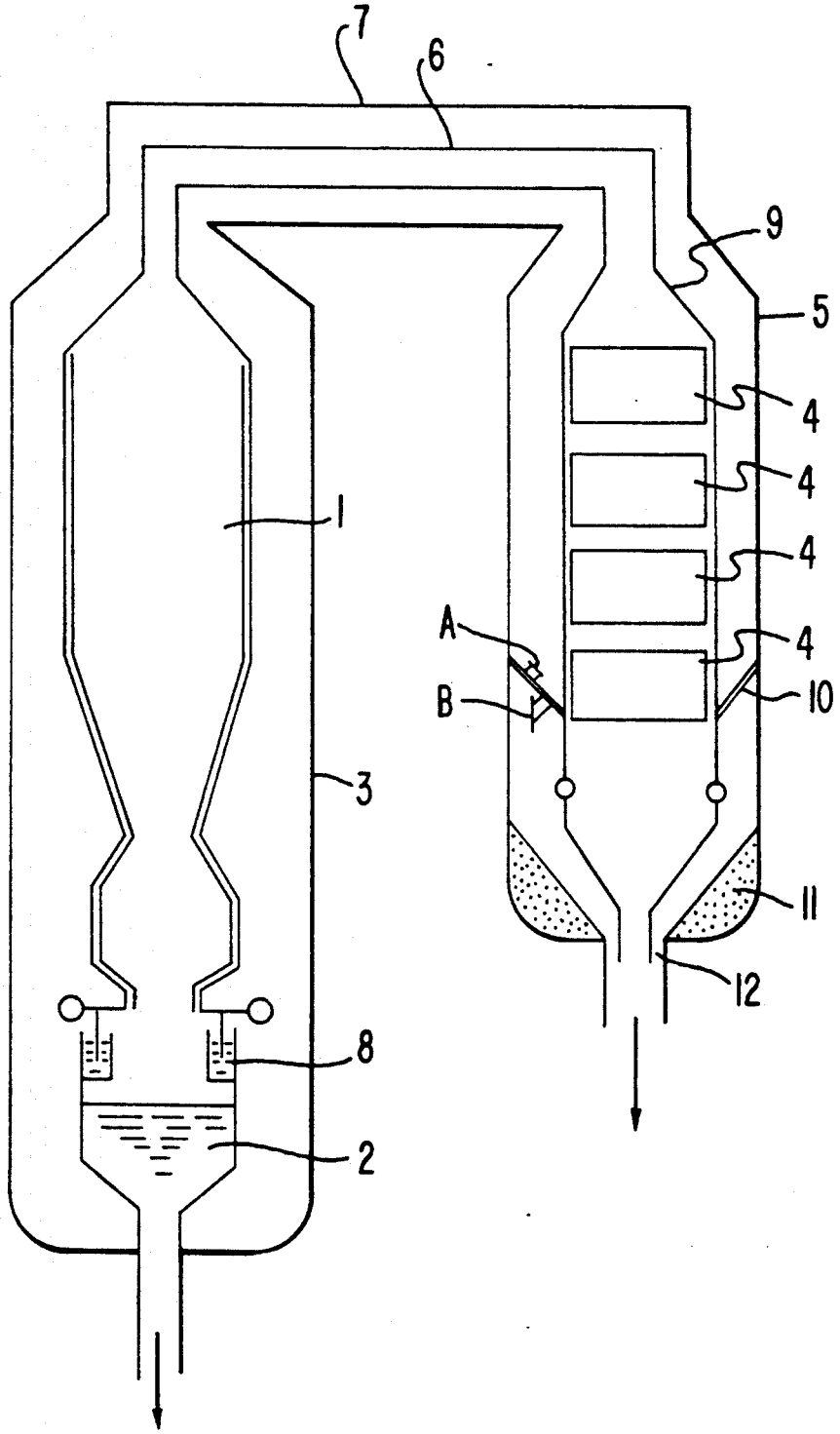
FIG. 1 is a schematic view of one preferred embodiment of the present invention.

At first, referring to FIG. 1, a gasification furnace main body 1 is formed of a water-cooled wall structure having its inner surface covered by refractory material, and it is disposed within a pressure vessel 3 along with a slag hopper 2. On the other hand, a plurality of gas cooling heat-exchangers 4 are contained within a duct 9 having a water-cooled wall structure, and further, the duct 9 is disposed within a pressure vessel 5. These pressure vessels 3 and 5 are connected by a pressure vessel connecting pipe 7 containing a gas communication pipe 6 therein so as to form a structure for maintaining a pressure balance between the respective pressure vessels. The gas communication pipe 6 places the interior of the gasification furnace main body 1 in communication with the interior of the water-cooled wall duct 9.

The slag ejection hopper 2 is connected with the gasification furnace main body I via a water seal mechanism 8 so that a difference in thermal expansion caused by a temperature difference between the gasification furnace main body 1 and the pressure vessel 3 can be accommodated for perfectly.

On the other hand, an outlet portion of the water-cooled water duct 9 containing the group of gas cooling heat-exchangers 4 therein is not directly connected with the pressure vessel 5 but communicates with the pressure vessel 5 via a gas passageway 12 so that a low-temperature gas at the outlet of the heat-exchanger group can freely flow into and out of the pressure vessel 5. Thanks to this gas passageway 12, a difference in thermal expansion between the water-cooled wall duct 9 and the pressure vessel 5 can be accommodated for, whereby the apparatus is highly reliable in that the gas cooling heat-exchanger group will not be damaged. This gas passageway 12 is dimensioned so as to insure a minimum clearance through which gas can flow at a necessary for maintaining a balance between the pressure in the water-cooled wall duct 9 and the pressure in the pressure vessel 5.

Figure 2:
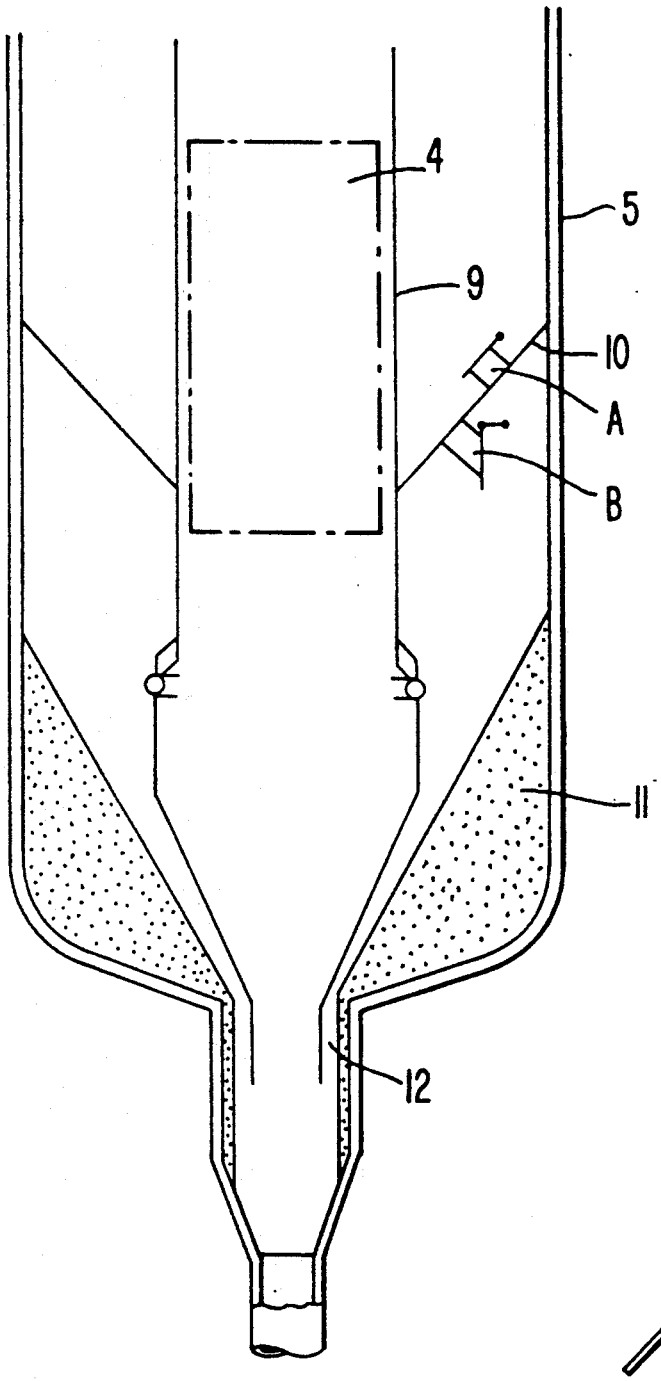
FIG. 2 is an enlarged schematic view of a bottom portion of a gas cooling heat-exchanger group in the same apparatus.

In addition, as shown more clearly in FIG. 2, a partition wall 10 is provided so as to connect the water-cooled duct 9 containing the heat exchanger group therein with the inner wall surface of the pressure vessel 5 at a level higher than the above-mentioned gas flow passageway 12. Furthermore, this partition wall 10 is provided with equalizing valves A and B which open only in the case where a pressure difference between the respective sides of the partition wall has become a predetermined value or larger.

Figure 3:
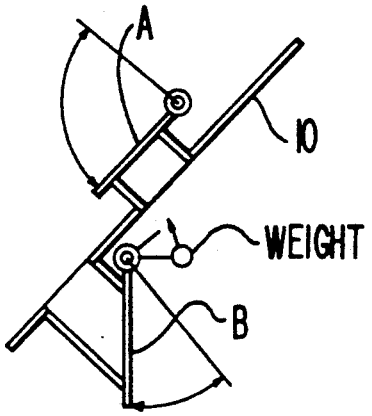
FIG. 3 is a detailed schematic view of equalizing valves in the same bottom portion.
Figure 4:
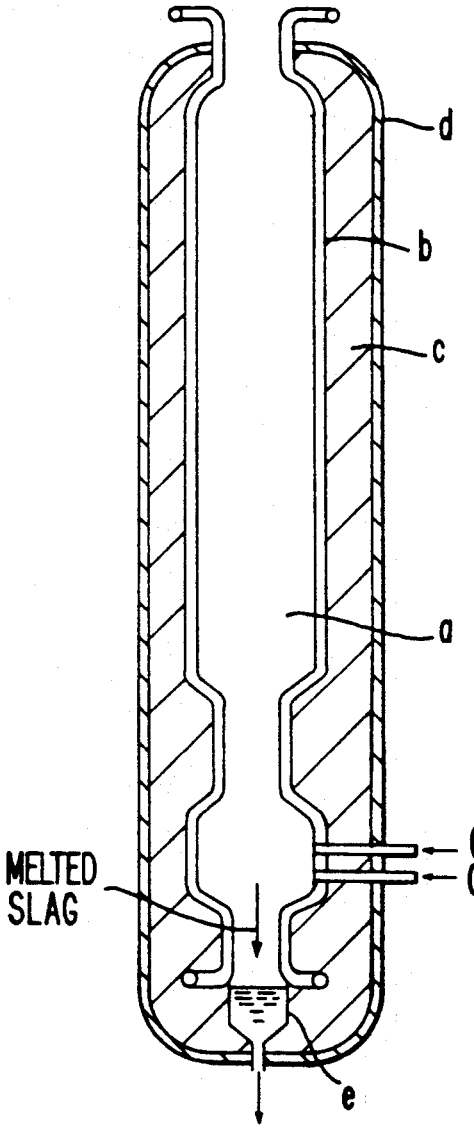
FIG. 4 (PRIOR ART)
FIGS. 4 to 6 are schematic views of respective pressurized type coal gasification apparatus in the prior art.
Figure 5:
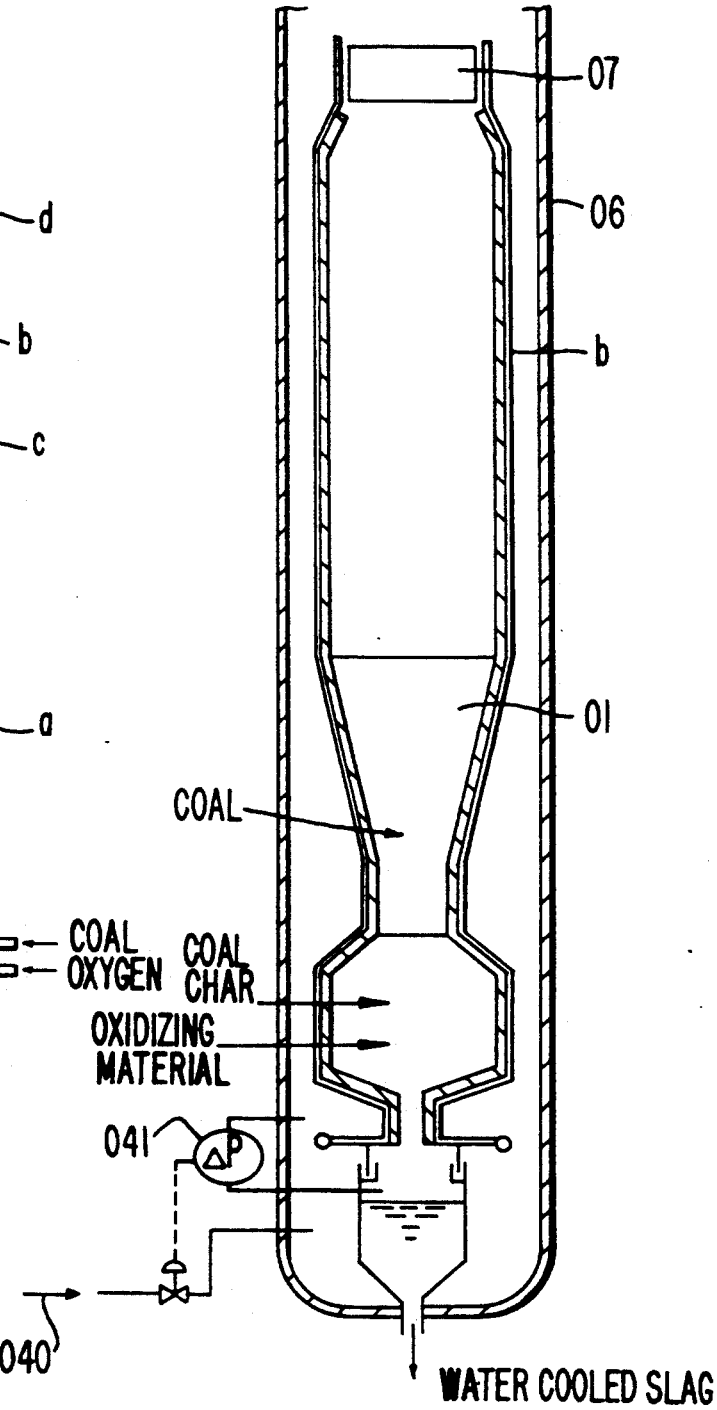
FIG. 5 (PRIOR ART)
Figure 6:
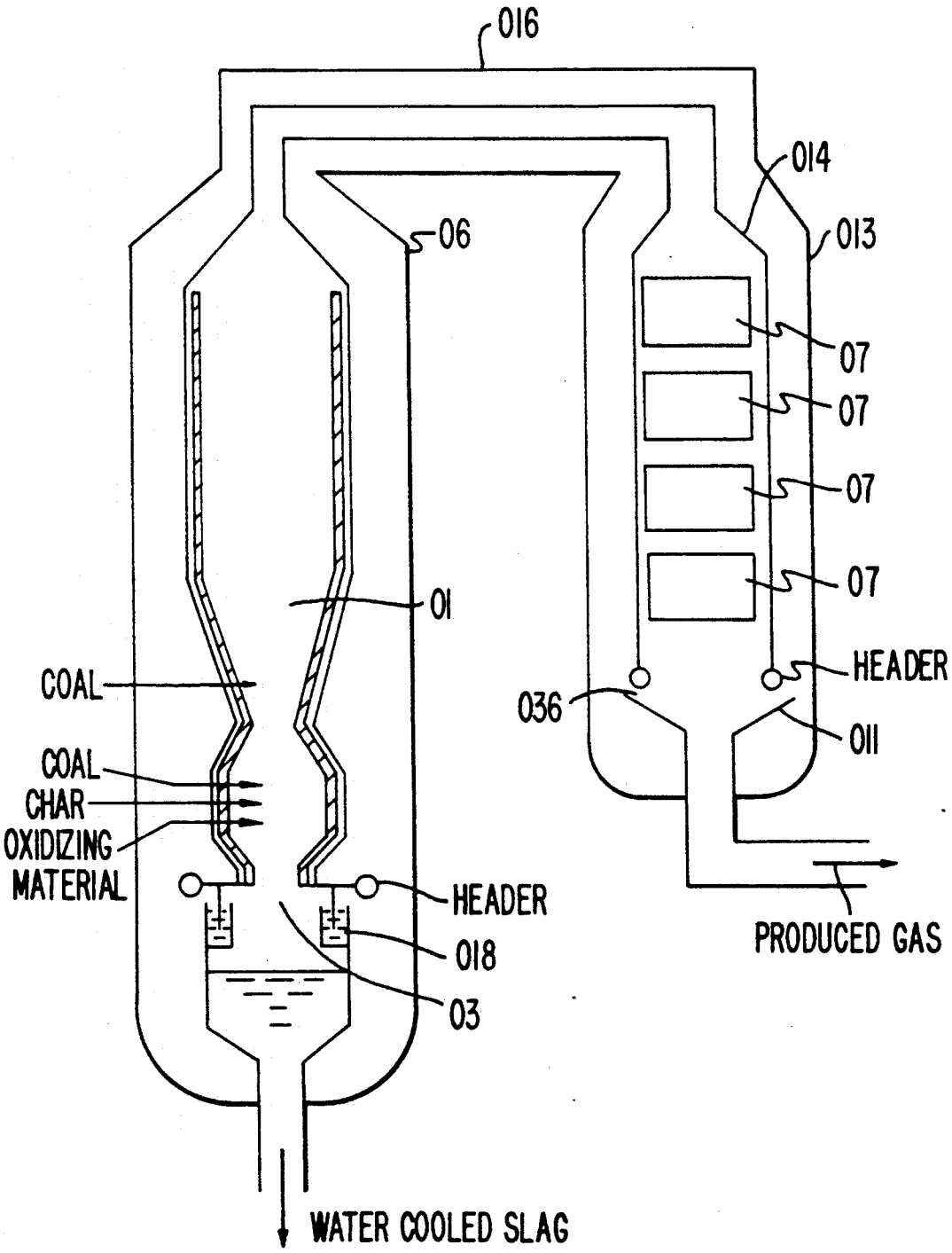
FIG. 6 (PRIOR ART)

FIG. 3 shows one example of the detailed structure of the equalizing valves A and B mounted to the partition wall 10. The equalizing valve A is constructed in such a manner that it will automatically open upwards against gravity in the case where the pressure under the partition wall 10 is higher than the pressure above the partition wall 10. The equalizing valve B is constructed in such a manner that it will automatically open against gravity acting upon a weight mounted to a valve body in the case where the pressure above the partition wall 10 is higher than the pressure under the partition wall 10.

It is to be noted that the bottom portion of the pressure vessel 5 under the partition wall 10 is formed as conical by means of refractory material 11 for the purpose of preventing dust accompanying the outflow and inflow of gas from accumulating at the bottom portion of the vessel 5 as much as possible.

In such an apparatus, a high-temperature gas produced within the gasification furnace main body 1 has its sensible heat thermally recovered in the gas cooling heat-exchanger group 4, and it is fed as a low-temperature gas to a subsequent installation (not shown). In addition, slag falling in the slag hopper disposed under the gasification furnace main body 1 is subsequently cooled and crushed.

In this preferred embodiment of the present invention, even in the event that the gas occupying the space between the pressure vessel 5 and the water-cooled wall duct 9 is heated by heat dissipating from the water-cooled wall duct 9 and a natural convection of the gas occurs due to a change in the specific gravity of the gas within the pressure vessel 5, gas at the gas passageway 12 at the outlet portion of the heat-exchanger group is not influenced because the partition wall 10 is provided. Thus, the lowering of the temperature caused by the low-temperature gas within the pressure vessel flowing into the principal flow of the produced gas can be prevented.

Furthermore, the equalizing valves A and B provided on this partition wall 10 ensure safety. More particularly, as described above, the equalizing valves A and B are provided for the purpose of maintaining the pressure difference between the inside of the water-cooled wall duct 9 and the inside of the pressure vessel 5 at a certain constant balanced pressure difference which insures safety of the apparatus. In the event that the pressure difference has exceeded this balanced pressure difference and has become abnormal, either one of the equalizing valves A and B would automatically open and the pressure difference would be returned to a normal value.

The above-described equalizing valves A and B have their appropriate specifications determined after a tolerable pressure difference has been calculated taking into consideration the structural strength and operating conditions of the pressurized type gasification apparatus. In addition, the equalizing valves have such a structure that a fine granular char component contained in the gas filling the inside of the pressure vessel 5 may hardly accumulate thereon. Furthermore, if the equalizing valves A and B are designed so that they can automatically maintain the pressure within the pressure vessel at an appropriate value even upon the start-up and stop of the pressurized type gasification apparatus and upon variations in the load on the apparatus, safety and reliability of the apparatus can be further improved. Specifically, the valves are designed so as to operate at a pressure difference of 50–600 mm water column taking into account a pressure difference between the upper side and the lower side of the partition wall, an effective aperture area and the weight of the equalizing valve, and the compressive strength of the water-cooled wall duct and the pressure vessel.

As described above, in the illustrated embodiment, the partition wall 10 is provided with the equalizing valves A and B within the pressure vessel 5.

As will thus be apparent from the pressurized type gasification apparatus according to the present invention, problems such as a lowering in the temperature of a produced gas which occurred in the prior art as the result of natural convection of the gas within the pressure vessel and of the risk of fire and explosion resulting from an accumulation of char within the pressure vessel are resolved. The apparatus thus exhibits high degrees of safety and reliability.

While a principle of the present invention has been described above in connection with one preferred embodiment of the invention, it is a matter of course that many apparently widely different embodiments of the present invention can be made without departing from the spirit of the invention.

We claim:

1. A pressurized gasification apparatus comprising: a gasification furnace main body having a water-cooled wall structure, a duct having a water-cooled wall structure, a group of gas cooling heat-exchangers contained within said duct, a pressure vessel in which said gasification furnace main body, said duct, and said group of gas cooling heat-exchangers are contained, the interior of said duct communicating with the interior of said gasification main furnace body so that said group of gas-cooling heat exchangers recover heat from gas produced in said gasification main body, said duct having an outlet communicating with the interior of said pressure vessel at a defined location in the apparatus, a partition wall connecting the wall of said duct with an inner wall surface of said pressure vessel so as to partition the interior of the pressure vessel into spaces on opposite sides of said partition wall, respectively, said partition wall being disposed at a level in the apparatus that is above the location where said outlet of the duct communicates with the interior of said pressure vessel, and equalizing valves operative to place the spaces on opposite sides of said partition wall in open communication with each other when a pressure difference on opposite sides of said partition wall has become a predetermined value or larger.

2. A pressurized gasification apparatus as claimed in claim 1, wherein at least one of said equalizing valves is operative to place the spaces on opposite sides of said partition wall in open communication with each other when pressure on one side of said partition wall has become higher than pressure on the other side thereof by a predetermined value or larger, and the remainder of said equalizing valves place the spaces on opposite sides of said partition wall in open communication with each other when the pressure on said other side of said partition wall has become higher than the pressure on said one side thereof by a predetermined value or larger.

3. A pressurized gasification apparatus as claimed in claim 1, wherein the outlet of said duct having a water-cooled wall structure forms a free end of said duct that is spaced inwardly from the inner wall surface of said pressure vessel at said location to thereby define a gas passageway between said outlet and the inner wall surface through which gas passageway the interior of said duct communicates with the interior of said pressure vessel.

* * * * *